US009761172B2

(12) United States Patent
Ryu

(10) Patent No.: US 9,761,172 B2
(45) Date of Patent: Sep. 12, 2017

(54) ORGANIC LIGHT EMITTING DIODE DISPLAY DEVICE AND DRIVING METHOD THEREOF

(75) Inventor: Do-Hyung Ryu, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 1669 days.

(21) Appl. No.: 13/105,823

(22) Filed: May 11, 2011

(65) Prior Publication Data

US 2011/0279433 A1 Nov. 17, 2011

(30) Foreign Application Priority Data

May 12, 2010 (KR) ..... 10-2010-0044586

(51) Int. Cl.
*G09G 3/30* (2006.01)
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0819* (2013.01); *G09G 2300/0852* (2013.01); *G09G 2320/0233* (2013.01); *G09G 2320/043* (2013.01); *G09G 2330/028* (2013.01)

(58) Field of Classification Search
CPC ..... G09G 3/3291; G09G 2320/0233; G09G 2320/043
USPC ..... 257/43, 213, 392, 411, 639, 640, 257/E27.119, E29.225, E29.32; 323/284; 326/98; 327/333, 389, 427, 434; 345/92, 345/76, 204, 211
See application file for complete search history.

(56) References Cited

U.S. PATENT DOCUMENTS

| | | | | |
|---|---|---|---|---|
| 6,121,642 | A * | 9/2000 | Newns | 257/192 |
| 6,504,489 | B1 * | 1/2003 | Westfield et al. | 340/870.3 |
| 2002/0190326 | A1 * | 12/2002 | Nagao et al. | 257/359 |
| 2008/0252570 | A1 * | 10/2008 | Kwon | 345/76 |
| 2009/0051628 | A1 * | 2/2009 | Kwon | 345/77 |

FOREIGN PATENT DOCUMENTS

| | | | |
|---|---|---|---|
| JP | 2006-065148 | 3/2006 | |
| JP | 2008-151946 | 7/2008 | |
| JP | 2008-151946 A * | 7/2008 | G09G 3/30 |

(Continued)

*Primary Examiner* — Michael J Eurice
(74) *Attorney, Agent, or Firm* — Robert E. Bushnell, Esq.

(57) ABSTRACT

An organic light emitting diode display device includes a display unit including a plurality of pixels; a data driver applying data voltage to the pixels; and a power supplier including a first power source providing high-level voltage to the anode electrode of organic light emitting diodes and a second power source providing low-level voltage to the cathode electrode of the organic light emitting diodes included in the pixels, in which the power supplier provides the second power source in a sink method at positive voltage, when the threshold voltage of a driving transistor for driving the organic light emitting diodes shifts to a negative. When gate-source voltage of a driving transistor shifts to negative threshold voltage, it is possible to apply the data voltage at positive voltage and to simplify a driving IC, thereby ensuring wide use, by applying voltage of a second power source ELVSS at positive voltage.

20 Claims, 4 Drawing Sheets

(56) References Cited

FOREIGN PATENT DOCUMENTS

| | | |
|---|---|---|
| KR | 1020050106834 | 11/2005 |
| KR | 1020080061760 | 7/2008 |
| KR | 10-0907399 | 7/2009 |
| KR | 1020100029811 | 3/2010 |

* cited by examiner

ORGANIC LIGHT EMITTING DIODE DISPLAY DEVICE AND DRIVING METHOD THEREOF

CLAIM OF PRIORITY

This application makes reference to, incorporates the same herein, and claims all benefits accruing under 35 U.S.C. §119 from an application earlier filed in the Korean Intellectual Property Office on the 12 of May 2010 and there duly assigned Ser. No. 10-2010-0044586.

BACKGROUND OF THE INVENTION

Field of the Invention

The present invention relates to an organic light emitting diode (OLED) display device and a driving method thereof and more particularly, to an organic light emitting diode display device using an n-channel field effect transistor as a driving transistor and a method of driving the organic light emitting diode display device.

Description of the Related Art

Recently, a variety of flat panel display devices that reduce weight and volume and solve drawbacks of cathode ray tubes, have been developed. The flat panel display devices may be classified into different types, for example, liquid crystal display (LCD) devices, field emission display devices, plasma display panels (PDP), and organic light emitting diode display devices.

The above information disclosed in this Background section is only for enhancement of understanding of the background of the invention and therefore it may contain information that does not form the prior art that is already known to a person of ordinary skill in the art.

SUMMARY OF THE INVENTION

The present invention has been made in an effort to provide an organic light emitting diode display device having advantages of that the OLED display device may be efficiently driven when a voltage difference between the gate electrode and the source electrode of a driving transistor shifts to a negative threshold voltage, in which an n-channel field effect transistor is used for the driving transistor' of the OLED display device, and to provide a method of driving the organic light emitting diode display device.

An embodiment of the present invention provides organic light emitting diode display device, the OLED display device includes a display unit including a plurality of pixels; a data driver applying data voltage to the pixels; and a power supplier including a first power source providing high-level voltage to the anode electrode of organic light emitting diodes and a second power source providing low-level voltage to the cathode electrode of the organic light emitting diodes in order to the organic light emitting diodes included in the pixels. When the threshold voltage of a driving transistor for driving the organic light emitting diodes shifts to a negative voltage, the power supplier provides the second power source at positive voltage by using a sink method.

The power supplier may include a power source voltage shift unit that shifts the second power source to a predetermined positive shift voltage.

The power source voltage shift unit may include a differential amplifier including a non-inverting input terminal where the voltage of the second power source is inputted and an inverting input terminal where the positive shift voltage is inputted; a first transistor including a gate electrode electrically connected to the output terminal of the differential amplifier and having one terminal electrically connected to the second power source; and a second transistor including a gate electrode electrically connected to the other terminal of the first transistor, and having one terminal electrically connected to the second power source and the other terminal electrically connected to a ground line.

The power source voltage shift unit may further include a feedback capacitor having one terminal electrically connected to the inverting input terminal of the differential amplifier and the other terminal electrically connected to the output terminal of the differential amplifier.

The power source voltage shift unit may further include a resistor having one terminal electrically connected to the output terminal of the differential amplifier and the other terminal electrically connected to the gate electrode of the first transistor in order to prevent oscillation of the power source voltage shift unit.

The first transistor and the second transistor may be bipolar junction transistors.

The pixel may include a pixel circuit electrically connected with a first scan line where a first scan signal is applied, a second scan line where a second scan signal is applied, a data line where data voltage is applied, and a light emitting line where a light emitting signal is applied.

The driving transistor may include a gate electrode electrically connected to the data line; and have one terminal electrically connected to the first power source and the other terminal electrically connected to the anode electrode of the organic light emitting diode.

The pixel may include a switching transistor including a gate electrode electrically connected to the first scan line and having one terminal electrically connected to the data line and the other terminal electrically connected to the gate electrode of the driving transistor.

The power supplier may provide reference voltage and initializing voltage to compensate the threshold voltage of the driving transistor.

The initializing voltage may be set lower than the voltage of the second power source.

The pixel may include an initializing transistor including a gate electrode electrically connected to the first scan line and having one terminal where the initializing voltage is transmitted and the other terminal electrically connected to the anode electrode of the organic light emitting diode; a reference potential transistor including a gate electrode electrically connected to the light emitting line and having one terminal where the reference voltage is transmitted and the other terminal electrically connected to anode; a light emitting transistor including a gate electrode electrically connected to the second scan line and having one terminal electrically connected to the node and the other terminal electrically connected to the gate electrode of the driving transistor; a first sustain capacitor having one terminal electrically connected to the gate electrode of the driving transistor and the other terminal electrically connected to the node; and a second sustain capacitor having one terminal electrically connected to the node and the other terminal electrically connected to the other terminal of the initializing transistor.

The first scan signal and the second scan signal may have a difference of at least two (2) horizontal periods.

The driving transistor may be an n-channel field effect transistor.

The data driver may apply the data voltage at a positive voltage lower than a predetermined positive voltage of the second power source.

The power supplier may include a DC-DC converter that converts first DC voltage of a DC power source into second DC voltage, provides voltage outputted by the second DC voltage from the non-inverting terminal to the first power source, and provides voltage outputted from the inverting terminal to the second power source.

Another embodiment of the present invention provides a method of driving an organic light emitting diode display device, which may include the steps of: when the threshold voltage of a driving transistor for driving an organic light emitting diode shifts to a negative voltage, providing high-level voltage of a first power source to the anode electrode of the organic light emitting diode; providing low-level voltage of a second power source, which is predetermined positive shift voltage, to the cathode electrode of the organic light emitting diode; and writing data to the organic light emitting diode by applying a positive data voltage set at a lower level in comparison to the voltage of the second power source to the gate electrode of the driving transistor.

The driving transistor may be an n-channel field effect transistor.

The positive shift voltage may be determined in accordance with the magnitude of threshold voltage shifting to the negative voltage such that the range of the data voltage is maintained at positive voltage.

The voltage of the second power source may be generated by the positive shift voltage inputted to an amplifier.

When gate-source voltage of a driving transistor shifts to a negative threshold voltage, it is possible to apply data voltage at positive voltage and simplify a driving IC, thereby ensuring wide use, by applying voltage of a second power source ELVSS at positive voltage.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE EMBODIMENTS

Figure 1:
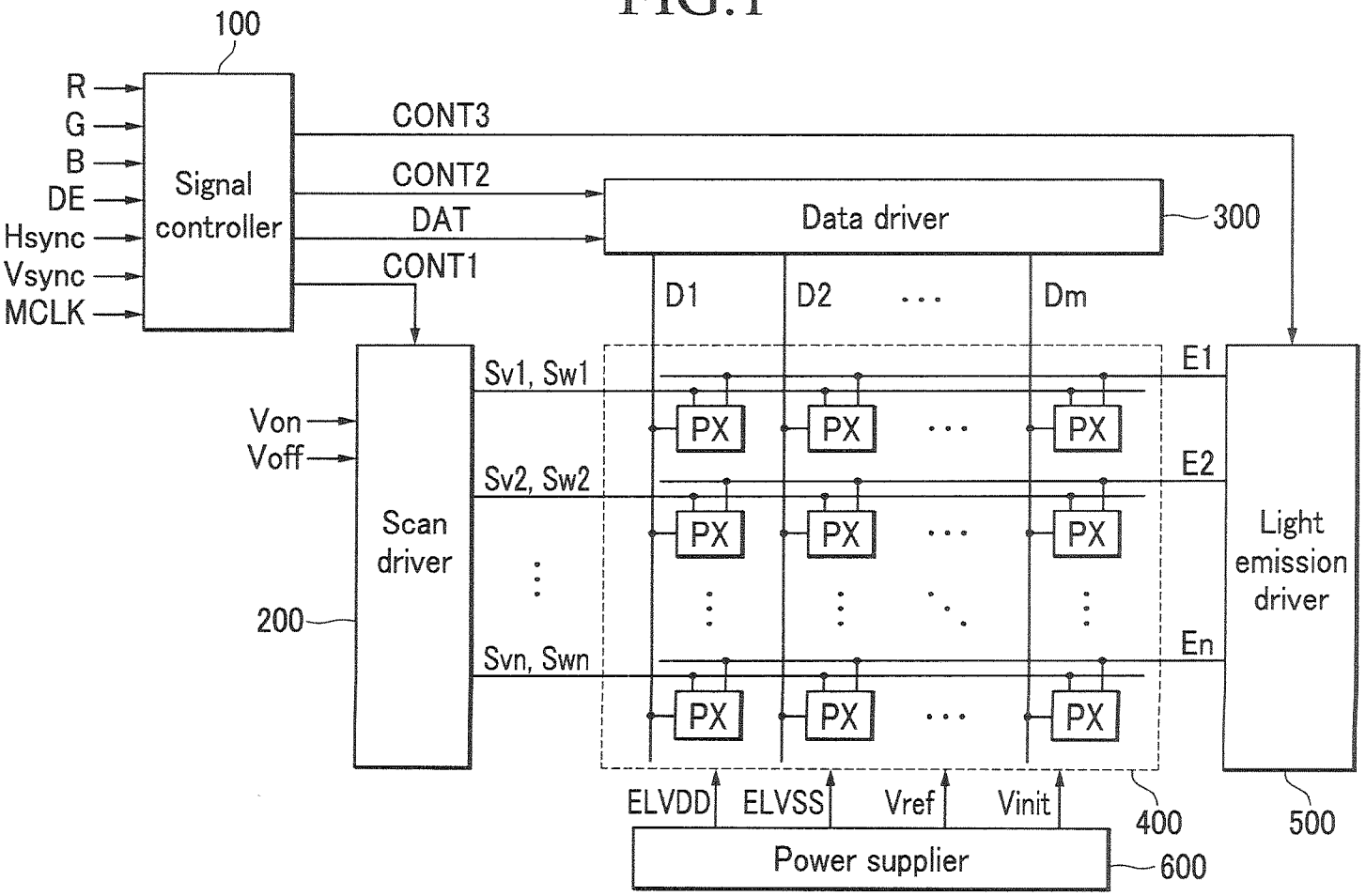
FIG. 1 is a block diagram illustrating an organic light emitting diode display device constructed as an embodiment of the present invention.

Among the flat panel display devices, the organic light emitting diode display device implements a video by using organic light emitting diodes which generate light by combining electrons and holes, and organic light emitting diode display device has higher response speed and excellent luminous efficiency, luminance, and viewing angle while consuming less power.

In general, the organic light emitting diode display devices are classified into a passive matrix type OLED (PMOLED) and an active matrix type OLED (AMOLED), in accordance with the method of driving the organic light emitting diodes. The AMOLED that selectively turns on/off the pixels is mainly used in terms of resolution, contrast, and operation speed.

The organic light emitting diode display device makes the organic light emitting diodes emit light by applying a voltage of a first power source ELVDD to the anode electrode of the organic light emitting diodes and a voltage of a second power source ELVSS to the cathode electrode of the organic light emitting diodes. In this configuration, pixel current flowing from the first power source ELVDD to the organic light emitting diodes is controlled by a driving transistor that is driven by data voltage. The driving transistor makes the organic light emitting diodes emit light by allowing the pixel current to flow, when the voltage difference between the gate electrode and the source electrode becomes larger than the threshold voltage.

When an n-channel field effect transistor is used for the driving transistor, the voltage difference between the gate electrode and the source electrode of the driving transistor may shift to a negative threshold voltage. Practically, the voltage difference between the gate electrode and source electrode of the n-channel field effect transistor usually shifts to negative threshold voltage, not positive threshold voltage, in the TFT process having reliability.

When the voltage difference between the gate electrode and the source electrode of the driving transistor shifts to negative threshold voltage, the driving transistor is not driven by positive data voltage, but normally driven by negative data voltage. The configuration of the driving IC however becomes complicated and the use range may be reduced in order to apply negative data voltage to the driving transistor.

The above information is only for enhancement of understanding of the background of the invention and therefore it may contain information that does not form the prior art that is already known to a person of ordinary skill in the art.

Hereinafter, the present invention will be described more fully hereinafter with reference to the accompanying drawings, in which these embodiments of the invention are shown. As those skilled in the art would realize, the described embodiments may be modified in various different ways, all without departing from the spirit or scope of the present invention.

Further, in a plurality of embodiments, like reference numerals are used for components having the same configuration representatively in a first embodiment, and other configurations different from the first embodiment are described in the other embodiments.

The drawings and description are to be regarded as illustrative in nature and not restrictive. Like reference numerals designate like elements throughout the specification.

In this specification and the claims that follow, when it is described that an element is "coupled" to another element, the element may be "directly coupled" to the other element and may together form a common node or "electrically coupled" to the other element through a third element. In addition, unless explicitly described to the contrary, the word "comprise" and variations such as "comprises" or "comprising," will be understood to imply the inclusion of stated elements but not the exclusion of any other elements.

Figure 2:
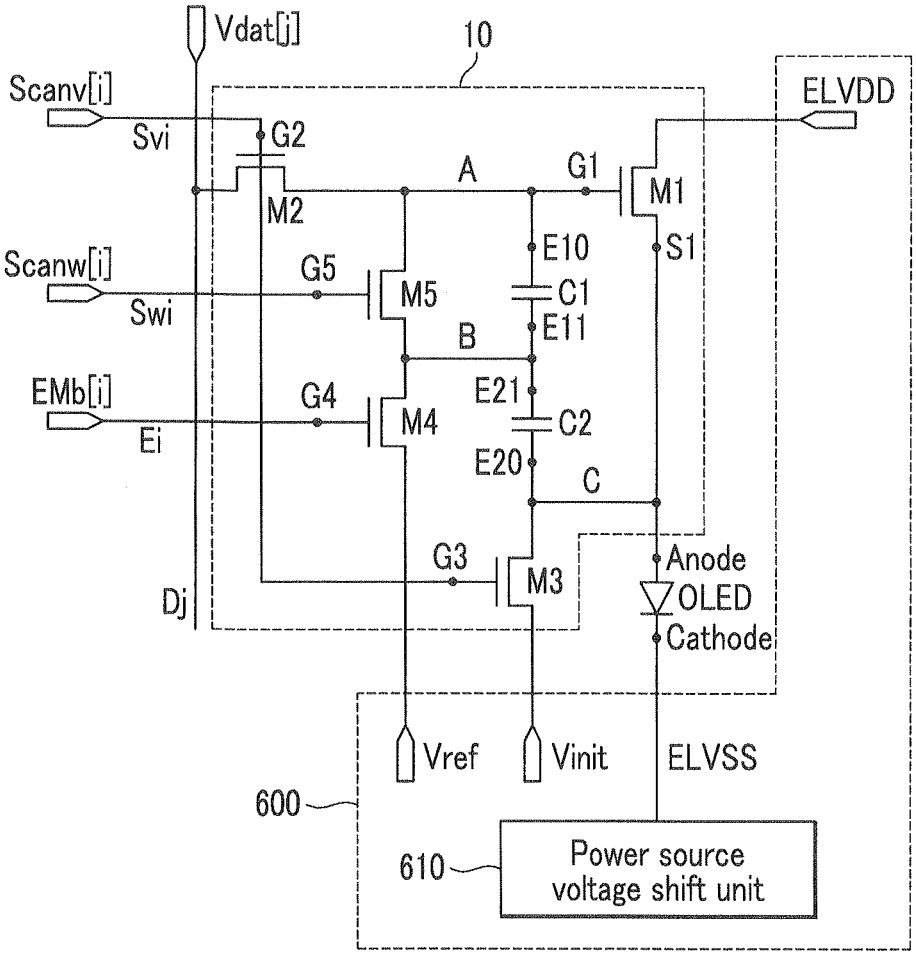
FIG. 2 is a circuit diagram illustrating a pixel constructed as an one embodiment of the present invention.
Figure 3:
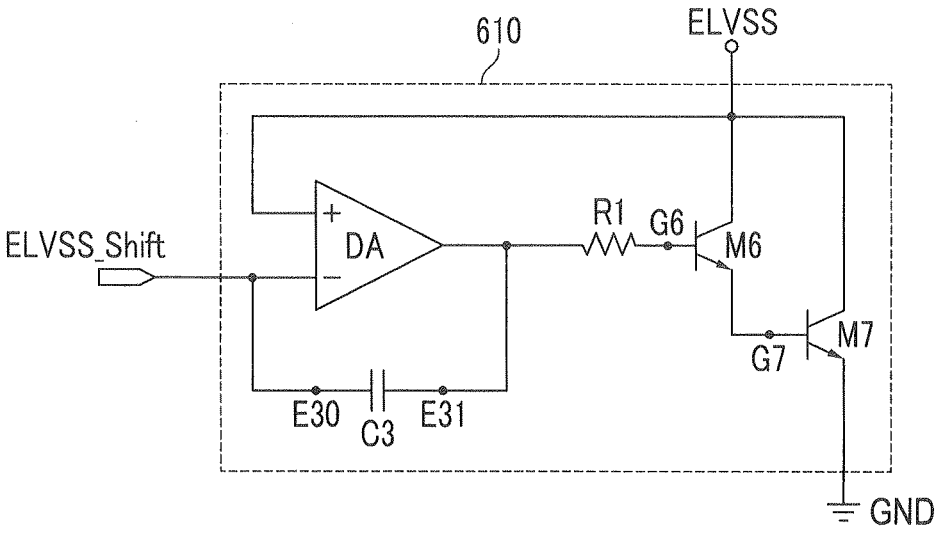
FIG. 3 is a circuit diagram illustrating a power source voltage shift unit constructed as an embodiment of the present invention.
Figure 4:
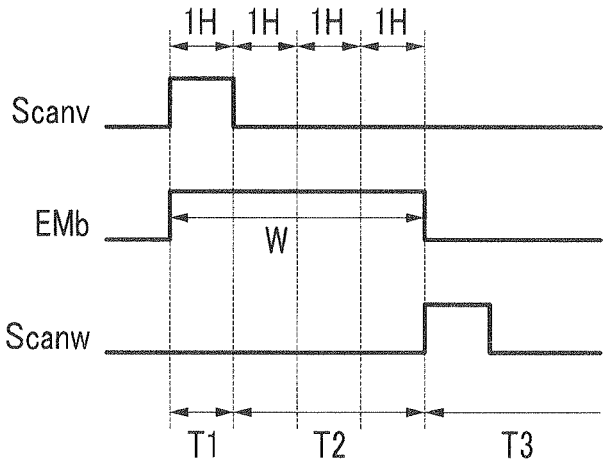
FIG. 4 is a group of waveforms illustrating a method of driving an organic light emitting diode display device constructed as for an embodiment of the present invention.
Figure 5:
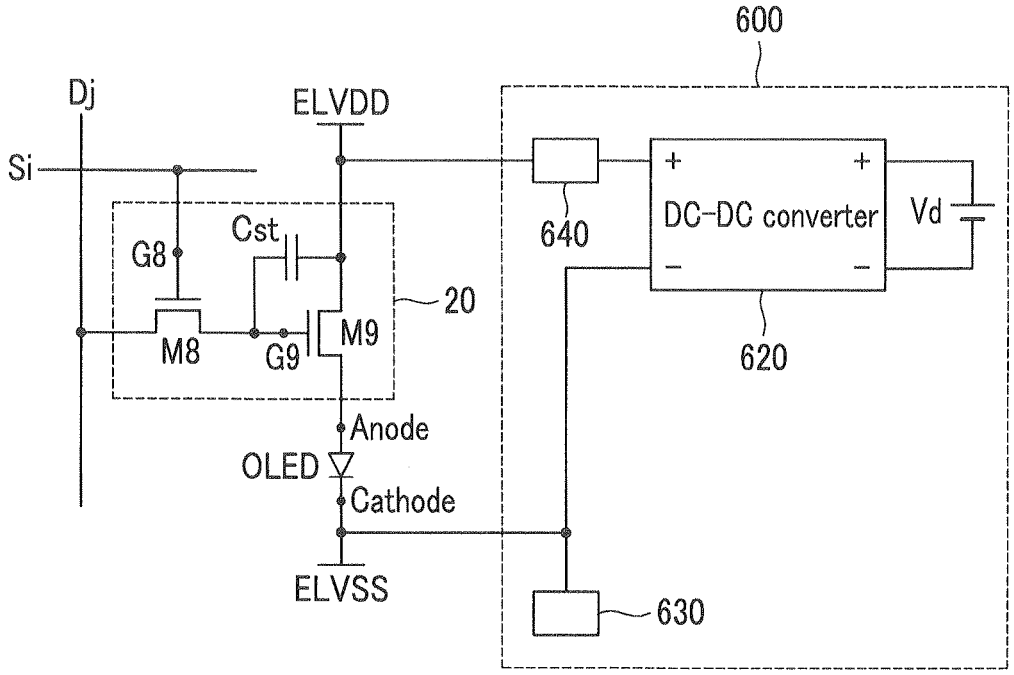
FIG. 5 is a circuit diagram illustrating a pixel and a voltage supply unit constructed as another embodiment of the present invention.

FIG. 1 is a block diagram illustrating an organic light emitting diode display device constructed as an embodiment of the present invention. FIG. 2 is a circuit diagram illustrating a pixel constructed as an embodiment of the present invention. FIG. 3 is a circuit diagram illustrating a power source voltage shift unit constructed as an embodiment of the present invention. FIG. 4 is a timing diagram illustrating a method of driving an organic light emitting diode display device constructed as an embodiment of the present invention. FIG. 5 is a circuit diagram illustrating a pixel and a voltage supply unit constructed as another embodiment of the present invention.

Referring to FIG. 1, an organic light emitting diode display device includes a signal controller 100, a scan driver 200, a data driver 300, a display unit 400, light emission driver 500, and power supplier 600.

The signal controller 100 receives video signals R, G, B inputted from an external device (not shown) and receives input control signals for controlling display of the video signals. The video signals R, G, B include luminance information of the pixels PX, and the luminance has a predetermined number, for example, $1024=2^{10}$, $256=2^{8}$ or $64=2^{6}$ grays. For example, the input control signal may be a vertical synchronization signal Vsync, a horizontal synchronization signal Hsync, a main clock MCLK, and a data enable signal DE.

The signal controller 100 appropriately processes the input video signals R, G, B to fit the operational conditions of the display unit 400 and the data driver 300 on the basis of the input video signal R, G, B and the input control signal, and the signal controller 100 generates a scan control signal CONT1, a data control signal CONT2, an image data signal DAT, and light emission control signal CONT3. The signal controller 100 transmits the scan control signal CONT1 to the scan driver 200. The signal controller 100 transmits the data control signal CONT2 and the image data signal DAT to the data driver 300. The signal controller 100 transmits the light emission control signal CONT3 to the light emission driver 500.

The display unit 400 includes a plurality of pixels PX electrically connected to a plurality of scan lines Sv1-Svn, Sw1-Swn, a plurality of data lines D1-Dm, a plurality of light emitting lines E1-En, and a plurality of signal lines Sv1-Svn, Sw1-Swn, D1-Dm, E1-En and arranged substantially in a matrix. The scan lines Sv1-Svn, Sw1-Swn and the light emitting lines E1-En extend substantially in the row direction substantially in parallel with each other and the data lines D1-Dm extend substantially in the column direction substantially in parallel with each other.

The scan driver 200 is electrically connected to the scan lines Sv1-Svn, Sw1-Swn and applies scan signals composed of combination of gate-on voltage Von and gate-off voltage Voff to the scan lines Sv1-Svn, Sw1-Swn, in accordance with a scan control signal CONT1.

The data driver 300 is electrically connected to the data lines D1-Dm and selects data voltage according to the image data signal DAT. The data driver 300 applies the data voltage selected according to the data control signal CONT2, as a data signal, to the data lines D1-Dm.

The light emission driver 500 is electrically connected to the light emitting lines E1-En and applies a light emitting signal composed of combination of gate-on voltage and gate-off voltage to the light emitting lines E1-En according to the light emission control signal CONT3.

The power supplier 600 supplies the first power source ELVDD, the second power source ELVSS, reference voltage Vref, and initializing voltage Vinit to the pixels PX. The first power source ELVDD is a power source that supplied high-level voltage to the anode electrode of the organic light emitting diodes to drive the organic light emitting diode included in the pixels PX. The second power source ELVSS is a power source that supplies low-level voltage to the cathode electrode of the organic light emitting diode.

The power supplier 600 may shift and supply the second power source ELVSS to a predetermined positive voltage. In this configuration, the initializing voltage Vinit may be set lower than the voltage of the second power source ELVSS and the reference voltage Vref may be set the same level as the voltage of the second power source ELVSS voltage.

The drivers 100, 200, 300, 500, and 600 described above may be each mounted directly on the display unit 400; or as at least one integrated circuit, be mounted on a flexible printed circuit film or on the display unit 400; or as a TCP (tape carrier package), be mounted on an independent printed circuit board; or be integrated on the display unit 400 together with the signal lines Sv1~Svn, Sw1~Swn, D1~Dm, E1~En.

Referring to FIG. 2, the pixel PX of the organic light emitting diode display device includes an organic light emitting diode OLED and a pixel circuit 10 for controlling the organic light emitting diode.

A first scan line Svi where the first scan signal Scanv[i] is applied, a second scan line Swi where a second scan signal Scanw[i] is applied, a data line Dj where a data signal Vdat[j] is applied, and a light emitting line Ei where a light emitting signal EMb[i] is applied, are electrically connected to the pixel circuit 10.

The pixel circuit 10 includes a driving transistor M1, a switching transistor M2, an initializing transistor M3, a reference potential transistor M4, a light emitting transistor M5, a first sustain capacitor C1, and a second sustain capacitor C2.

The switching transistor M2 includes the gate electrode G2 electrically connected to the first scan line Svi, and one of the source and drain electrodes of the switching transistor M2 is electrically connected to the data line Dj and the other one of the source and drain electrodes of the switching transistor M2 is electrically connected to the gate electrode G1 of the driving transistor M1.

The driving transistor M1 includes the gate electrode G1 electrically connected to the other one of the source and drain electrodes of the switching transistor M2, and one of the source and drain electrodes of the driving transistor M1 is electrically connected to the first power source ELVDD and the other one of the source and drain electrodes of the driving transistor M1 is electrically connected to the anode electrode of the organic light emitting diode OLED. The driving transistor M1 controls pixel current flowing to the organic light emitting diode OLED in accordance with data voltage transmitted to the gate electrode G1 of the driving transistor M1.

The initializing transistor M3 includes the gate electrode G3 electrically connected to the first scan line Svi, and one of the source and drain electrodes of the initializing transistor M3 is electrically connected to the power supplier 600 in order to receive initializing voltage Vinit and the other one of the source and drain electrodes of the initializing transistor M3 is electrically connected to the anode electrode of the organic light emitting diode OLED.

The reference potential transistor M4 includes the gate electrode G4 electrically connected to the light emitting line Ei, and one of the source and drain electrodes of the reference potential transistor M4 is electrically connected to the power supplier 600 to receive reference voltage Vref and the other one of the source and drain electrodes of the reference potential transistor M4 is electrically connected to one of the source and drain electrodes of the light emitting transistor M5.

The light emitting transistor M5 includes the gate electrode G5 electrically connected to the second scan line Swi, and one of the source and drain electrodes of the light emitting transistor M5 is electrically connected to the other one of the source and drain electrodes of the reference potential transistor M4 and the other one of the source and drain electrodes of the light emitting transistor M5 is electrically connected to the gate electrode G1 of the driving transistor M1.

The first sustain capacitor C1 has one terminal E10 electrically connected to the gate electrode G1 of the driving transistor M1 and the other terminal E11 electrically connected to the one of the source and drain electrodes of the light emitting transistor M5.

The second sustain capacitor C2 has one terminal E21 electrically connected to the other one of the source and drain electrodes of the reference potential transistor M4 and the other terminal E20 electrically connected to the other one of the source and drain electrodes of the initializing transistor M3.

The gate electrode G1 of the driving transistor M1, the other one of the source and drain electrodes of the switching transistor M2, the other one of the source and drain electrodes of the light emitting transistor M5, and one terminal E10 of the first sustain capacitor C1 are electrically connected to a node A.

The other one of the source and drain electrodes of the reference potential transistor M4, one of the source and drain electrodes of the light emitting transistor M5, the terminal E11 of the first sustain capacitor C1, and one terminal E21 of the second sustain capacitor C2 are electrically connected to a node B.

The other one of the source and drain electrodes of the driving transistor M1, the other one of the source and drain electrodes of the initializing transistor M3, the other one of the source and drain electrodes of the second sustain capacitor C2, and the anode electrode of the organic light emitting diode OLED are electrically connected to a node C.

The driving transistor M1, switching transistor M2, initializing transistor M3, reference potential transistor M4, and light emitting transistor M5 may be n-channel field effect transistors. In this configuration, the gate-on voltage that turns on the driving transistor M1, switching transistor M2, initializing transistor M3, reference potential transistor M4, and light emitting transistor M5 is logic high-level voltage, and the gate-off voltage that turns off these transistors is logic low-level voltage.

Even though it is exemplified in the present embodiment that the transistors may be n-channel field effect transistors, at least one of the driving transistor M1, switching transistor M2, initializing transistor M3, reference potential transistor M4, and light emitting transistor M5 may be a p-channel field effect transistor. Gate-on voltage that turns on the p-channel field effect transistor is logic low-level voltage and gate-off voltage that turns off the p-channel field effect transistor is logic high-level voltage.

The organic light emitting diode OLED is electrically connected between the pixel circuit 10 and the second power source ELVSS, and the organic light emitting diode OLED emits light at luminance corresponding to the current supplied from the pixel circuit 10. The organic light emitting diode OELD may produce a color of light in the primary colors. For example, the primary colors may be the three primary colors, red, green and blue, and desired colors are implemented by spatial or total combination of the primary colors. In this configuration, some of the organic light emitting diodes may emit white light, in which the luminance increases. Alternatively, the organic light emitting diodes in all of the pixels PX may emit white light and some of the pixels PX may further include a color filter (not shown) that change the white light emitted from the organic light emitting diodes into any one of the primary colors.

The voltage difference between the gate electrode G1 and the source electrode (for example, S1) of the driving transistor M1 is called gate-source voltage Vgs (i.e., Vgs=Vg−Vs). The driving transistor M1 is turned on, when the gate-source voltage Vgs of the driving transistor M1 is higher than a threshold voltage Vth of the driving transistor M1; while the driving transistor M1 is turned off, when gate-source voltage Vgs becomes lower than the threshold voltage Vth. In this configuration, the pixel current flowing to the organic light emitting diode through the turned-on driving transistor M1 is proportional to a square of the difference between the gate-source voltage Vgs and the threshold voltage Vth.

When the voltage of the second power source ELVSS has ground voltage of 0V, the data voltage Vdat applied to the gate electrode of the driving transistor M1 is applied as positive voltage to make the organic light emitting diode OLED emit light.

For example, when the voltage of the second power source ELVSS is 0V and the threshold voltage Vth of the driving transistor M1 is +1V, the data voltage Vdat may be applied to the gate electrode G1 of the driving transistor M1 within +1V~+5V. Accordingly, the driving transistor M1 allows the pixel current at the gate-source voltage Vgs within the range of +1V~+5V to flow to the organic light emitting diode.

Practically, the gate-source voltage Vgs of the n-channel field effect transistor usually shifts to a negative threshold voltage Vth, not a positive threshold voltage Vth, in the TFT process having reliability. The gate-source voltage Vgs of the driving transistor M1 shifts to a negative threshold voltage Vth, the data voltage Vdat applied to the gate electrode G1 of the driving transistor M1 should be set to a negative voltage in order to drive the driving transistor M1 with respect to the second power source ELVSS having the ground voltage of 0V.

For example, when the voltage of the second power source ELVSS is 0V and the gate-source voltage Vgs of the driving transistor M1 shifts to a threshold voltage Vth of −1V, the data voltage Vdat is applied to the gate electrode of the driving transistor M1 within the range of −1~−5V and the driving transistor M1 allows pixel current corresponding to the gate-source voltage Vgs within the range of −1~−5V to flow to the organic light emitting diode. When the threshold voltage of the driving transistor M1, which is an n-channel field effect transistor (NMOSFET), shifts to a negative voltage value, the transistor operates as a p-channel field effect transistor (PMOSFET). That is, current is generated in the driving transistor M1, when the voltage applied to the gate electrode G1 is lower than the source electrode voltage, as much as the negative threshold voltage Vth.

When the gate-source voltage Vgs of the driving transistor M1 shifts to a negative threshold voltage Vth, the configuration driving IC for applying negative data voltage Vdat becomes complicated and the use range may be reduced.

In accordance with the present invention, when the gate-source voltage Vgs of the driving transistor M1 shifts to a negative threshold voltage Vth, the voltage of the second power source ELVSS is a positive voltage and the data voltage Vdat is applied at a lower positive level compared to the voltage of the second power source ELVSS. For example, when the gate-source voltage Vgs of the driving transistor M1 shifts to threshold voltage Vth of −1V and the voltage of the second power source ELVSS is 5V, data voltage Vdat may be applied within the range of 0~4V to the gate electrode G1 of the driving transistor M1 and the driving transistor M1 allows pixel current corresponding to the gate-source voltage Vgs in the range of −1~−5V to flow to the organic light emitting diode.

By implementing the voltage of the second power source ELVSS as a power source having positive voltage and applying the data voltage at a lower positive level than the voltage of the second power source EVLSS, the configuration of the driving IC may be simplified and the driving method can be simplified in accordance with degree of negative shift of the threshold voltage Vth.

The power supplier 600 includes a power source voltage shift unit 610, and the power source voltage shift unit 610 shifts the second power source ELVSS to predetermined positive voltage. That is, the power source voltage shift unit 610 shifts the voltage of the second power source ELVSS to a predetermined positive voltage such that data voltage may be applied at positive voltage, when the gate-source voltage Vgs of the driving transistor M1 shifts to a negative threshold voltage Vth.

Referring to FIG. 3, the power source voltage shift unit 610 includes a differential amplifier DA, a resistor R1 electrically connected to the output terminal of the differential amplifier DA, a feedback capacitor C3 electrically connected between the output terminal and an inverting input terminal (−1) of the differential amplifier DA, a first transistor M6 having a gate electrode electrically connected to the output terminal of the differential amplifier DA, and a second transistor M7 forming a Darlington transistor together with the first transistor M6.

The differential amplifier DA has a non-inverting input terminal (+) where the voltage of the second power source ELVSS is inputted, an inverting input terminal (−) where positive shift voltage ELVSS_Shift is inputted, and an output terminal electrically connected to the gate electrode of the first transistor M6.

The feedback capacitor C3 has one terminal E30 electrically connected to the inverting input terminal (−) of the differential amplifier DA and the other terminal E31 electrically connected to the output terminal of differential amplifier DA. The resistor R1 has one terminal electrically connected to the output terminal of the differential amplifier and the other terminal electrically connected to the gate electrode G6 of the first transistor M6. The feedback capacitor C3 and the resistor R1 prevent oscillation of the power source voltage shift unit 610.

The first transistor M6 includes the gate electrode G6 electrically connected to the other terminal of the resistor R1 to receive output voltage of the differential amplifier DA, and the first transistor M6 has one of the source and drain electrodes electrically connected to the second power source ELVSS and the other one of the source and drain electrodes electrically connected to the gate electrode G7 of the second transistor M7. The second transistor M7 includes the gate electrode G7 electrically connected to the other one of the source and drain electrodes of the first transistor M6, and the second transistor M7 has one of the source and drain electrodes electrically connected to the second power source ELVSS and the other one of the source and drain electrodes electrically connected to a ground line GND. The first transistor M6 and the second transistor M7 may be bipolar junction transistors.

When the threshold voltage Vth of the driving transistor M1 shifts to a negative voltage, the positive shift voltage ELVSS_Shift is determined in accordance with the magnitude of voltage shifting to negative voltage. That is, the shift voltage ELVSS_Shift is set to voltage where the range of the data voltage is maintained at positive voltage. When there is not shift to negative voltage, the voltage of the second power source ELVSS is set to voltage at a ground level.

When the threshold voltage Vth of the driving transistor M1 shifts to a negative voltage, the positive shift voltage ELVSS_Shift that makes the data voltage positive is inputted to the inverting input terminal (−) of the differential amplifier DA and the voltage of the second power source ELVSS is converted into the positive shift voltage ELVSS_Shift.

When there is a voltage difference between the voltage of the second power source ELVSS and the shift voltage ELVSS_Shift, the first transistor M6 and the second transistor M7 are turned on by output voltage of the differential amplifier DA, in which the output voltage is produced by a voltage difference between the voltage of the second power source ELVSS inputted to the non-inverting input terminal (+) and the shift voltage ELVSS_Shift inputted to the inverting input terminal (−). When the first transistor M6 and the second transistor M7 are turned on, the voltage of the second power source ELVSS is electrically connected to the ground GND and is reduced.

When the reduced voltage of the second power source ELVSS becomes the same as the shift voltage ELVSS_Shift, the output voltage of the differential amplifier DA becomes at a low level and the low level is applied to the gate of the first transistor M6, such that the first transistor M6 is turned off. Accordingly, the gate voltage of the second transistor M7 becomes at a low level, such that the second transistor M7 is also turned off. When the first transistor M6 and the second transistor M7 are turned off, the voltage of the second power source ELVSS is maintained at the shift voltage ELVSS_Shift.

Therefore, the voltage of the second power source ELVSS shifts to and is maintained at the predetermined positive shift voltage ELVSS_Shift. For example, in order to shift the voltage of the second power source ELVSS to +5V, when +5V is inputted to the inverting input terminal (−) of the differential amplifier DA of the power source voltage shift unit 610, the voltage of the second power source ELVSS shifts to +5V.

Hereafter, a method of driving an organic light emitting diode display device is described with reference to FIGS. 1 through 4.

Referring to FIGS. 1 through 4, an organic light emitting diode display device constructed as the present invention operates in a sequential driving way, including a data writing period T1 where a data signal Vdat is transmitted and is written in the pixels, a threshold voltage compensating period T2 where the threshold voltage of the driving transistors M1 of the pixels are compensated, and light emitting period T3 where the pixels emit light.

In this configuration, 1H implies a one (1) horizontal period corresponding to a horizontal synchronization signal Hsync and a data enable signal DE. The gate-source voltage Vgs of the driving transistor M1 shifts to a negative threshold voltage Vth, the voltage of the second power source ELVSS shifts to a predetermined positive shift voltage ELVSS_Shift, and the data voltage Vdat is applied at a lower positive voltage compared to the voltage of the second power source ELVSS. The initializing voltage Vinit may be set at lower voltage compared to the voltage of the second power source ELVSS. The reference voltage Vref may be set to the voltage of the second power source ELVSS voltage of positive shift voltage ELVSS_Shift.

During the data writing period T1, the first scan signal Scanv and the light emitting signal EMb are applied at voltage of a logic high level and the second scan signal Scanw is applied at voltage of a logic low level. In this process, the data voltage Vdat is applied at a predetermined positive voltage.

When the first scan signal Scanv is applied at voltage of a logic high level, both of the switching transistor M1 and the initializing transistor M3 are turned on. Data voltage Vdat is transmitted to the node A through the switching transistor M1 turned on. Initializing voltage Vinit is transmitted to the node C through the initializing transistor M3 turned on. The data voltage Vdat at the node A turns on the driving transistor M1. Since the initializing voltage Vinit is set lower than the voltage of the second power source ELVSS, current does not flow to the organic light emitting diode even if the driving transistor M1 is turned on.

When the light emitting signal EMb is applied at voltage of a logic high level, the reference potential transistor M4 is turned on. Reference voltage Vref is transmitted to the node B through the reference potential transistor M4 turned on.

That is, the data voltage Vdat is applied to the terminal E10 of the first sustain capacitor C1 and the reference voltage Vref is applied to the terminal E11. Further, the reference voltage Vref is applied to the terminal E21 of the second sustain capacitor C2 and the initializing voltage Vinit is applied to the terminal E20. During the data writing period T1, the data voltage Vdat is written to the first sustain capacitor C1 and the second sustain capacitor C2 is initialized to the initializing voltage Vinit.

During the threshold voltage compensating period T2, the first scan signal Scanv is applied at voltage of a logic low level and the light emitting signal EMb is maintained at voltage of a logic high level. When the first scan signal Scanv is applied at voltage of a logic low level, the switching transistor M2 and the initializing transistor M3 are turned off. As the switching transistor M2 is turned off, the gate electrode G1 of the driving transistor M1 and the terminal E10 of the first sustain capacitor C1 are floated.

During the threshold voltage compensating period T2, the source voltage of the driving transistor M1 increases up to a level where the gate-source voltage Vgs becomes the threshold voltage Vth. In this process, the second sustain capacitor C2 is charged by the voltage V_C2 in which V_C2=Vref−Vdat+Vth.

The threshold voltage compensating period T2 where the threshold voltage Vth of the driving transistor M1 is compensated may be controlled in accordance with the width W of the light emitting signal EMb. Even though the threshold voltage compensating period T2 may be a three (3) horizontal periods in the present embodiment, it may be determined as a period where the threshold voltage Vth may be sufficiently experimentally compensated. For example, the threshold voltage compensating period T2 may be a one (1) horizontal period or an one (1) or more horizontal period.

During the light emitting period T3, the light emitting signal EMb is applied at voltage of a logic low level and the second scan signal Scam is applied at voltage of a logic high level. When the light emitting signal EMb is applied at voltage of a logic low level, the reference potential transistor M4 is turned off. When the second scan signal Scanw is applied at voltage of a logic high level, the light emitting transistor M5 is turned on.

The first scan signal Scanv that turns on the switching transistor M2 and the second scan signal Scanw that turns on the light emitting transistor M5 have a time difference of at least two (2) horizontal periods or more. For example, when the threshold voltage compensating period T2 is an one (1) horizontal period, the second scan signal Scanw becomes a scan signal after the two (2) horizontal period at the first scan signal Scanv. That is, when the first scan signal Scanv is the n-th scan signal Scan[n], the second scan signal Scanw is the [n+2]-th scan signal Scan[n+2]. As described above, the period of the first scan signal Scanv and the second scan signal Scanw applied to the pixel may be determined in accordance with the threshold voltage compensating period T2, that is, the width W of the light emitting signal EMb.

During the light emitting period T3, when the reference potential transistor M4 is turned off and the light emitting transistor M5 is turned on, the voltage V_C2 of the second sustain capacitor C2 is applied to the gate-source voltage Vgs of the driving transistor M1. Accordingly, pixel current $I_{OLED}$ flowing to the organic light emitting diode is $I_{OLED}=a\times(Vgs-Vth)^2=a\times\{(Vref-Vdat+Vth)-Vth\}^2=a\times(Vref-Vdat)^2$ (where a is a constant). Therefore, the current flowing to the organic light emitting diode is not affected by deviation of the threshold voltage Vth of the driving transistor M1. Accordingly, it is possible to prevent luminance deviation due to the deviation of the threshold voltage Vth of the driving transistor M1.

As described above, when gate-source voltage Vgs of the driving transistor M1 shifts to a negative threshold voltage Vth, the power source voltage shift unit 610 supplied predetermined positive shift voltage ELVSS_Shift to the voltage of the second power source ELVSS, such that the data voltage Vdat may be applied at positive voltage. Therefore, the existing driving IC may be used for the data driver 300 generating the data voltage, and the configuration of the driving IC may be simplified.

Referring to FIG. 5, a pixel PX of an organic light emitting diode display device constructed as another embodiment of the present invention includes an organic light emitting diode and a pixel circuit 20 for controlling the organic light emitting diode. The pixel circuit 20 includes a switching transistor M8, a driving transistor M9, and a sustain capacitor Cst.

The switching transistor M8 includes a gate electrode G8 electrically connected to a scan line Si, and the switching transistor M8 has one of the source and drain electrodes electrically connected to a data line Dj and the other one of the source and drain electrodes electrically connected to the gate electrode G9 of a driving transistor M9. The switching transistor M8 applies a data signal to the gate electrode of the driving transistor M9 in accordance with the scan signal.

The driving transistor M9 includes the gate electrode G9 electrically connected to the other one of the source and drain electrodes electrically of the switching transistor M8, and the driving transistor M9 has one of the source and drain electrodes electrically connected to the ELVDD power source and the other one of the source and drain electrodes electrically connected to the anode electrode of the organic light emitting diode.

The sustain capacitor Cst has one terminal electrically connected to the gate electrode of the driving transistor M9 and the other terminal electrically connected to the ELVDD power source.

The organic light emitting diode OLED has an anode electrode electrically connected to the other one of the source and drain electrodes of the driving transistor M9 and a cathode electrode electrically connected to the ELVSS power source.

The switching transistor M8 and the driving transistor M9 may be n-channel field effect transistors. This is not limitative and any one of the switching transistor M8 and driving transistor M9 may be a p-channel field effect transistor.

When gate-on voltage Von is applied to the scan line Si, the switching transistor M8 is turned on and a data signal applied to the data line Dj is applied to one terminal of the sustain capacitor Cst through the switching transistor M8 turned on, such that the sustain capacitor Cst is charged. The driving transistor M9 controls the amount of current flowing to organic light emitting diode from the ELVDD power source, corresponding to the voltage value of the sustain capacitor Cst.

The organic light emitting diode generates light corresponding to the amount of current flowing through the driving transistor M9.

Meanwhile, the power supply unit 600 includes a DC-DC converter 620 for generating voltage of the first power source ELVDD and voltage of the second power source ELVSS, an LDO (Low Drop Out) regulator 630, and a step-down converter 640.

The DC-DC converter 620 is a circuit device that converts first DC voltage of a DC power source Vd into second DC voltage. The DC-DC converter 620 includes a first non-inverting terminal (+) connected to the positive (+) terminal of the DC power source Vd and a first inverting terminal (−) connected to the negative (−) terminal of the DC power source Vd. Further, the DC-DC converter 620 includes a second non-inverting terminal (+) and a second inverting terminal (−) that output second DC voltage, corresponding to the first voltage of the DC power source Vd. The DC-DC converter 620 provides the voltage outputted by the second DC voltage from the second non-inverting terminal (+) to the first power source ELVDD and provides the voltage outputted from the second inverting terminal (−) to the second power source ELVSS.

The LDO regulator 630 is electrically connected to the second inverting terminal (−) of the DC-DC converter 620 to keep constant the output voltage of the second inverting terminal (−) which is transmitted to the second power source ELVSS. The LDO regulator 630 outputs positive voltage higher than the ground, and in the present embodiment, the level is the level of predetermined positive shift voltage ELVSS_shift of the second power source ELVSS.

The step-down converter 640 is electrically connected to the second non-inverting terminal (+) of the DC-DC converter 620 to reduce in a step-down method the output voltage of the second non-inverting terminal (+) which is transmitted to the first power source ELVDD and transmit the output voltage to the first power source ELVDD. The level of the output voltage of the step-down converter 640 is the level of the first power source ELVDD. The step-down method reduces a voltage supplied from an exterior to an internal circuit.

As described above, the power supplier 600 may provide the second power source ELVSS at positive voltage in a sink method, by using the power-saving DC-DC converter 620. In the sink method, a voltage supplied from an exterior of a circuit is adjusted by this circuit and this circuit outputs an adjusted voltage that has been altered. In the sink method, the electric current may flow towards this circuit. In the sink method, this circuit may receive the electric current.

The drawings and the detailed description described above are examples for the present invention and provided to explain the present invention and the scope of the present invention described in the claims is not limited thereto. Therefore, it will be appreciated to those skilled in the art that various modifications are made and other equivalent embodiments are available. Accordingly, the actual scope of the present invention must be determined by the spirit of the appended claims.

DESCRIPTION OF SYMBOLS

100: Signal controller
200: Scan driver
300: Data driver
400: Display unit
500: Light emission driver
600: Power supplier
610: Power source voltage shift unit

What is claimed is:

1. An organic light emitting diode display device, comprising:

a display unit including a plurality of pixels;

a data driver applying a data voltage to the pixels; and a power supplier including a first power source providing a first-level voltage to an anode electrode of organic light emitting diodes and a second power source providing a second and lower-level voltage to a cathode electrode of the organic light emitting diodes in order to drive the organic light emitting diodes which are included in the plurality of pixels, wherein, when a threshold voltage of a driving transistor electrically coupled to drive the organic light emitting diodes shifts to a negative voltage value, the power supplier adjusts the second power source to become a positive voltage.

2. The organic light emitting diode display device of claim 1, wherein the power supplier includes a DC-DC converter that converts a first DC voltage of a DC power source into a second DC voltage, provides a first voltage outputted in accordance with the second DC voltage from a non-inverting terminal to the first power source, and provides a second voltage outputted from an inverting terminal to the second power source.

3. The organic light emitting diode display device of claim 1, wherein the driving transistor is an n-channel field effect transistor.

4. The organic light emitting diode display device of claim 3, wherein the data driver applies the data voltage having a positive voltage lower than a predetermined positive voltage of the second power source.

5. The organic light emitting diode display device of claim 1, wherein the power supplier includes a power source voltage shift unit that shifts the second power source to a predetermined positive shift voltage.

6. The organic light emitting diode display device of claim 5, wherein the power source voltage shift unit includes:

a differential amplifier including a non-inverting input terminal where the voltage of the second power source is inputted and an inverting input terminal where the predetermined positive shift voltage is input;

a first transistor including a gate electrode electrically connected to an output terminal of the differential amplifier and the first transistor having one of source and drain electrodes electrically connected to the second power source; and a second transistor including a gate electrode electrically connected to another of the source and drain electrodes of the first transistor, and the second transistor having one of source and drain electrodes electrically connected to the second power source and another of the source and drain electrodes electrically connected to a ground line.

7. The organic light emitting diode display device of claim 6, wherein the power source voltage shift unit further includes a feedback capacitor having one terminal electrically connected to the inverting input terminal of the differential amplifier and another terminal electrically connected to the output terminal of the differential amplifier.

8. The organic light emitting diode display device of claim 6, wherein the power source voltage shift unit prevents oscillation in response to a resistor having one terminal electrically connected to the output terminal of the differential amplifier and another terminal electrically connected to the gate electrode of the first transistor.

9. The organic light emitting diode display device of claim 6, wherein the first transistor and the second transistor comprise bipolar junction transistors.

10. The organic light emitting diode display device of claim 1, wherein the pixel comprises a pixel circuit electrically connected to a first scan line where a first scan signal is applied, electrically connected to a second scan line where a second scan signal is applied, electrically connected to a data line where the data voltage is applied, and electrically connected to a light emitting line where a light emitting signal is applied.

11. The organic light emitting diode display device of claim 10, wherein the driving transistor comprises:

a gate electrode electrically connected to the data line;

one of source and drain electrodes electrically connected to the first power source; and another of the source and drain electrodes electrically connected to the anode electrode of the organic light emitting diode.

12. The organic light emitting diode display device of claim 11, wherein the pixel comprises a switching transistor including a gate electrode electrically connected to the first scan line and the switching transistor having one of source and drain electrodes electrically connected to the data line and another of the source and drain electrodes electrically connected to the gate electrode of the driving transistor.

13. The organic light emitting diode display device of claim 11, wherein the power supplier compensates for variations in the threshold voltage of the driving transistor by providing a reference voltage and an initializing voltage to the pixel.

14. The organic light emitting diode display device of claim 13, wherein the initializing voltage is set at a voltage value lower than a voltage of the second power source.

15. The organic light emitting diode display device of claim 13, wherein the pixel includes:

an initializing transistor including a gate electrode electrically connected to the first scan line and the initializing transistor having one of source and drain electrodes to which the initializing voltage is transmitted and another of the source and drain electrodes electrically connected to the anode electrode of the organic light emitting diode;

a reference potential transistor including a gate electrode electrically connected to the light emitting line and the reference potential transistor having one of source and drain electrodes to which the reference voltage is transmitted and another of the source and drain electrodes electrically connected to a node;

a light emitting transistor including a gate electrode electrically connected to the second scan line and the light emitting transistor having one of source and drain electrodes electrically connected to the node and another of the source and drain electrodes electrically connected to the gate electrode of the driving transistor;

a first sustain capacitor having one terminal electrically connected to the gate electrode of the driving transistor and another terminal electrically connected to the node; and a second sustain capacitor having one terminal electrically connected to the node and the other terminal electrically connected to another of the source and drain electrodes of the initializing transistor.

16. The organic light emitting diode display device of claim 15, wherein appliances of the first scan signal and the second scan signal have a time difference of at least two (2) horizontal periods.

17. A method of driving an organic light emitting diode display device, the method comprising:

when a threshold voltage of a driving transistor for driving an organic light emitting diode shifts to a negative voltage value, providing a high-level voltage of a first power source to an anode electrode of the organic light emitting diode;

providing a low-level voltage of a second power source, which is a predetermined positive shift voltage, to a cathode electrode of the organic light emitting diode; and writing data to the organic light emitting diode by applying a positive data voltage which is set at a lower level compared to the low-level voltage of the second power source to a gate electrode of the driving transistor.

18. The method of claim 17, wherein the driving transistor is an n-channel field effect transistor.

19. The method of claim 17, wherein the predetermined positive shift voltage is determined in accordance with a magnitude of the threshold voltage of the driving transistor shifting to the negative voltage such that the range of the data voltage is maintained to be within a positive voltage value range.

20. The method of claim 17, wherein the voltage of the second power source is generated by the predetermined positive shift voltage inputted to an amplifier.

* * * * *